US007228900B2

(12) United States Patent
Schultz et al.

(10) Patent No.: US 7,228,900 B2
(45) Date of Patent: Jun. 12, 2007

(54) SYSTEM AND METHOD FOR DETERMINING DOWNHOLE CONDITIONS

(75) Inventors: Roger L. Schultz, Aubrey, TX (US); Neal G. Skinner, Lewisville, TX (US); Pete C. Dagenais, The Colony, TX (US); Orlando De Jesus, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 409 days.

(21) Appl. No.: 10/868,695

(22) Filed: Jun. 15, 2004

(65) Prior Publication Data

US 2005/0274513 A1 Dec. 15, 2005

(51) Int. Cl.
*E21B 47/10* (2006.01)
*E21B 43/04* (2006.01)
*E21B 43/08* (2006.01)

(52) U.S. Cl. ..... 166/250.01; 166/51; 166/66; 166/227; 166/278

(58) Field of Classification Search ..... 166/254.1, 166/66, 278, 227, 51, 64, 231, 242.1, 254.2, 166/250.01; 367/27, 28; 324/324, 637, 324/642, 643
See application file for complete search history.

(56) References Cited

U.S. PATENT DOCUMENTS 3,500,950 A * 3/1970 Roever ..... 367/103
3,688,188 A 8/1972 Bak et al.
4,422,043 A 12/1983 Meador
4,541,486 A 9/1985 Wetzel et al.
4,783,995 A 11/1988 Michel et al.
4,890,682 A 1/1990 Worrall et al.
4,918,375 A * 4/1990 Malicki et al. ..... 324/642
4,950,892 A 8/1990 Olesen
4,972,906 A 11/1990 McDaniel
5,026,141 A 6/1991 Griffiths
5,181,565 A 1/1993 Czernichow
5,243,562 A 9/1993 Laurent et al.
5,247,156 A 9/1993 Favre
5,302,894 A 4/1994 Hrubes
5,309,405 A 5/1994 Brett et al.
5,332,038 A 7/1994 Tapp et al.

(Continued)

FOREIGN PATENT DOCUMENTS

EP 952444 A1 * 10/1999

OTHER PUBLICATIONS

Dowding et al.; Real Time Monitoring of Infrastructure using TDR Technology; Structural Materals Technology NDT Conference 2000; 8 pages.

(Continued)

*Primary Examiner*—Kenneth Thompson
(74) *Attorney, Agent, or Firm*—Lawrence R. Youst

(57) ABSTRACT

The present invention provides a system for determining downhole conditions including a time domain reflectometer (172) that is operable to generate a transmission signal and receive a reflected signal. A tubular (192) is positioned downhole in a downhole medium (214, 216, 218, 220, 222) and a waveguide (186), which is in electrical communication with the time domain reflectometer (172), is operably contacting the downhole (214, 216, 218, 220, 222). The waveguide (186) is operable to propagate the transmission signal and operable to propagate the reflected signal that is generated responsive to an electromagnetic property of the downhole medium (214, 216, 218, 220, 222).

106 Claims, 7 Drawing Sheets

U.S. PATENT DOCUMENTS

| | | | | |
|---|---|---|---|---|
| 5,337,808 | A | 8/1994 | Graham | |
| 5,339,895 | A | 8/1994 | Arterbury et al. | |
| 5,355,720 | A | 10/1994 | Bailey | |
| 5,376,888 | A | 12/1994 | Hook | |
| 5,420,517 | A | 5/1995 | Skaling et al. | |
| 5,448,222 | A | 9/1995 | Harman | |
| 5,472,506 | A | 12/1995 | Tohma et al. | |
| 5,476,143 | A | 12/1995 | Sparlin et al. | |
| 5,481,105 | A | 1/1996 | Gold | |
| 5,515,915 | A | 5/1996 | Jones et al. | |
| 5,563,605 | A | 10/1996 | McEwan | |
| 5,570,028 | A | 10/1996 | Sperlazzo et al. | |
| 5,577,559 | A | 11/1996 | Voll et al. | |
| 5,579,842 | A | 12/1996 | Riley | |
| 5,608,328 | A | 3/1997 | Sanderson | |
| 5,609,059 | A | 3/1997 | McEwan | |
| 5,610,611 | A | 3/1997 | McEwan | |
| 5,661,385 | A | 8/1997 | McEwan | |
| 5,662,165 | A | 9/1997 | Tubel et al. | |
| 5,664,628 | A | 9/1997 | Koehler et al. | |
| 5,696,863 | A | 12/1997 | Kleinerman | |
| 5,726,578 | A | 3/1998 | Hook | |
| 5,730,223 | A | 3/1998 | Restarick | |
| 5,784,338 | A | 7/1998 | Yankielum et al. | |
| 5,829,520 | A | 11/1998 | Johnson | |
| 5,841,666 | A | 11/1998 | Perude et al. | |
| 5,875,852 | A | 3/1999 | Floyd et al. | |
| 5,896,928 | A | 4/1999 | Coon | |
| 5,898,310 | A | 4/1999 | Liu | |
| 5,925,879 | A | 7/1999 | Hay | |
| 5,941,307 | A | 8/1999 | Tubel | |
| 5,963,317 | A | 10/1999 | Hamid et al. | |
| 5,964,296 | A | 10/1999 | Ross | |
| 6,065,535 | A | 5/2000 | Ross | |
| 6,084,393 | A | 7/2000 | Yankielun | |
| 6,100,700 | A | 8/2000 | Yankielum et al. | |
| 6,114,857 | A | 9/2000 | Kohl | |
| 6,121,894 | A | 9/2000 | Yankielum et al. | |
| 6,125,933 | A | 10/2000 | Ross | |
| 6,144,209 | A | 11/2000 | Raymond et al. | |
| 6,281,489 | B1 | 8/2001 | Tubel et al. | |
| 6,281,801 | B1 * | 8/2001 | Cherry et al. | 340/605 |
| 6,330,913 | B1 | 12/2001 | Langseth et al. | |
| 6,343,651 | B1 | 2/2002 | Bixnman | |
| 6,357,525 | B1 | 3/2002 | Langseth et al. | |
| 6,374,913 | B1 | 4/2002 | Robbins et al. | |
| 6,435,025 | B1 | 8/2002 | Krause | |
| 6,441,622 | B1 | 8/2002 | Wrzesinski et al. | |
| 6,446,729 | B1 | 9/2002 | Bixenman et al. | |
| 6,450,257 | B1 * | 9/2002 | Douglas | 166/250.02 |
| 6,513,599 | B1 | 2/2003 | Bixenman et al. | |
| 6,526,189 | B1 | 2/2003 | Yankielum | |
| 6,554,064 | B1 | 4/2003 | Restarick et al. | |
| 6,581,454 | B1 | 6/2003 | Smith | |
| 6,632,534 | B2 | 10/2003 | Skaling et al. | |
| 6,684,951 | B2 | 2/2004 | Restarick et al. | |
| 6,686,745 | B2 | 2/2004 | Bass | |
| 2002/0007945 | A1 * | 1/2002 | Neuroth et al. | 166/66 |
| 2002/0007948 | A1 | 1/2002 | Bayne et al. | |
| 2002/0074119 | A1 | 6/2002 | Bixenman et al. | |
| 2002/0092649 | A1 * | 7/2002 | Bixenman et al. | 166/278 |
| 2002/0148610 | A1 | 10/2002 | Bussear et al. | |
| 2003/0024155 | A1 | 2/2003 | Kuroda et al. | |
| 2003/0037615 | A1 | 2/2003 | Madaras et al. | |
| 2003/0071637 | A1 * | 4/2003 | Dahan | 324/643 |
| 2004/0173352 | A1 * | 9/2004 | Mullen et al. | 166/278 |

OTHER PUBLICATIONS

'Time Domain Reflectometry'; Campbell Scientific; 4 pages.
'Time-Domain Reflectometry'; 4 pages.

* cited by examiner

SYSTEM AND METHOD FOR DETERMINING DOWNHOLE CONDITIONS

TECHNICAL FIELD OF THE INVENTION

This invention relates, in general, to determining downhole conditions in a wellbore that traverse a subterranean hydrocarbon bearing formation and, in particular, to a system and method for real time sampling of downhole conditions during completion and production operations utilizing time domain reflectometry.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulates. For example, the particulates cause abrasive wear to components within the well, such as tubing, pumps and valves. In addition, the particulates may partially or fully clog the well creating the need for an expensive workover. Also, if the particulate matter is produced to the surface, it must be removed from the hydrocarbon fluids using surface processing equipment.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a relatively coarse particulate material, such as sand, gravel or proppants, which is typically sized and graded and which is referred to herein as gravel, is then pumped down the work string and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

It has been found, however, that a complete gravel pack of the desired production interval is difficult to achieve. For example, incomplete packs may result from the premature dehydration of the fluid slurry due to excessive loss of the liquid carrier into highly permeable portions of the production interval causing the gravel to form sand bridges in the annulus. Thereafter, the sand bridges may prevent the slurry from flowing to the remainder of the annulus which, in turn, prevents the placement of sufficient gravel in the remainder of the annulus.

Numerous attempts have been made to improve the quality of the gravel packs. For example, changing fluid slurry parameters including flow rate, viscosity and gravel concentration and providing alternate paths for the fluid slurry delivery provide for a more complete gravel pack in some completion scenarios. Even using these improved techniques, however, a nonuniform distribution of the gravel that results in the presence of localized spaces that are void of gravel within the production interval is typically undetectable. As such, well operators are typically not aware that corrective action is required until after sand production from the well has commenced.

Accordingly, a need has arisen for a system and method for gravel packing a production interval traversed by a wellbore that provide for monitoring downhole conditions during a gravel packing operation. A need has also arisen for such a system and method that generate a real time profile of the downhole conditions surrounding the sand control screen. A need has further arisen for such a system and method that inform well operators that corrective action is required during both the completion and production phases of well operation.

SUMMARY OF THE INVENTION

A system and method are disclosed that are utilized to determine downhole conditions during a variety of wellbore operations such as completion operations including gravel packing, fracture packing, high rate water packing and the like as well as production operations. The system and method of the present invention generate a real time profile of downhole conditions that may be utilized by a well operator to determine the quality of a gravel pack as well as the type of fluid being produced into specific regions of the production interval.

In one aspect, the present invention is directed to a system for determining downhole conditions that includes a time domain reflectometer operable to generate a transmission signal and receive a reflected signal. A tubular is positioned in a downhole medium and a waveguide, which may comprise a plurality of transmission lines, is operalby contacting the downhole medium and is in communication with the time domain reflectometer. The time domain reflectometer transmits pulses, such as electrical or optical pulses, through the waveguide and receives reflections indicative of spatial changes in the electrical properties of the downhole medium. More specifically, the electromagnetic properties of the waveguide are influenced by the electrical properties of the downhole medium and change in response to changes in the medium.

The time domain reflectometer includes a signal generator and a signal receiver. In one embodiment, time domain reflectometer includes a step generator and an oscilloscope. In another embodiment, the time domain reflectometer includes a signal generator and sampler, a datalogger and a data interpreter. The time domain reflectometer may generate a transmission signal having a short rise time and may sample and digitize the reflected signal. The downhole medium in which the waveguide is positioned may include constituents such as water, gas, sand, gravel, proppants, oil and the like. In operation, once the reflected signal is received by the time domain reflectometer, a profile of the downhole medium may be generated based upon the amplitude and phase of the reflected signal, by comparing the reflected signal to a control waveform or by comparing the reflected signal to the transmitted signal. The electromagnetic profile of the downhole medium is created due to variations in the electromagnetic properties of the downhole medium such as impedance, resistance, inductance or capacitance.

In another aspect, the present invention is directed to a method for determining downhole conditions. The method comprises the steps of generating a transmission signal, propagating the transmission signal through a transmission line operably contacting a downhole medium, reflecting the transmission signal in response to an electromagnetic property of the downhole medium, receiving the reflected signal and analyzing the reflected signal to determine at least one downhole condition.

In a further aspect, the present invention is directed to an apparatus for determining downhole conditions that includes a tubular positioned in a downhole medium and a waveguide operably contacting the downhole medium. The waveguide may include one or more transmission lines. In an embodiment having three transmission lines, one of the transmission lines is positioned between the other two transmission lines such that the transmission lines are approximately equidistant from one another. The transmission lines of the waveguide are operable to propagate a transmission signal received from a time domain reflectometer and propagate a reflected signal generated responsive to an electromagnetic property of the downhole medium. In one embodiment, the transmission lines of the waveguide may form U-shaped patterns on the tubular, a helical pattern about the tubular or traverse the tubular a plurality of times. In addition, the electrical characteristics of the distal end of one or more of the transmission lines may be altered to alter characteristics of the reflected signal from the distal end.

In yet another aspect, the present invention is directed to a system for determining downhole conditions that includes a time domain reflectometer which generates a short rise time electromagnetic pulse transmission signal and samples a reflected signal. A sand control screen assembly is positioned in a downhole medium with a waveguide operably contacting the downhole medium and in communication with the time domain reflectometer. The waveguide is operable to propagate the transmission signal and operable to propagate the reflected signal generated responsive to an electromagnetic property of the downhole medium.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
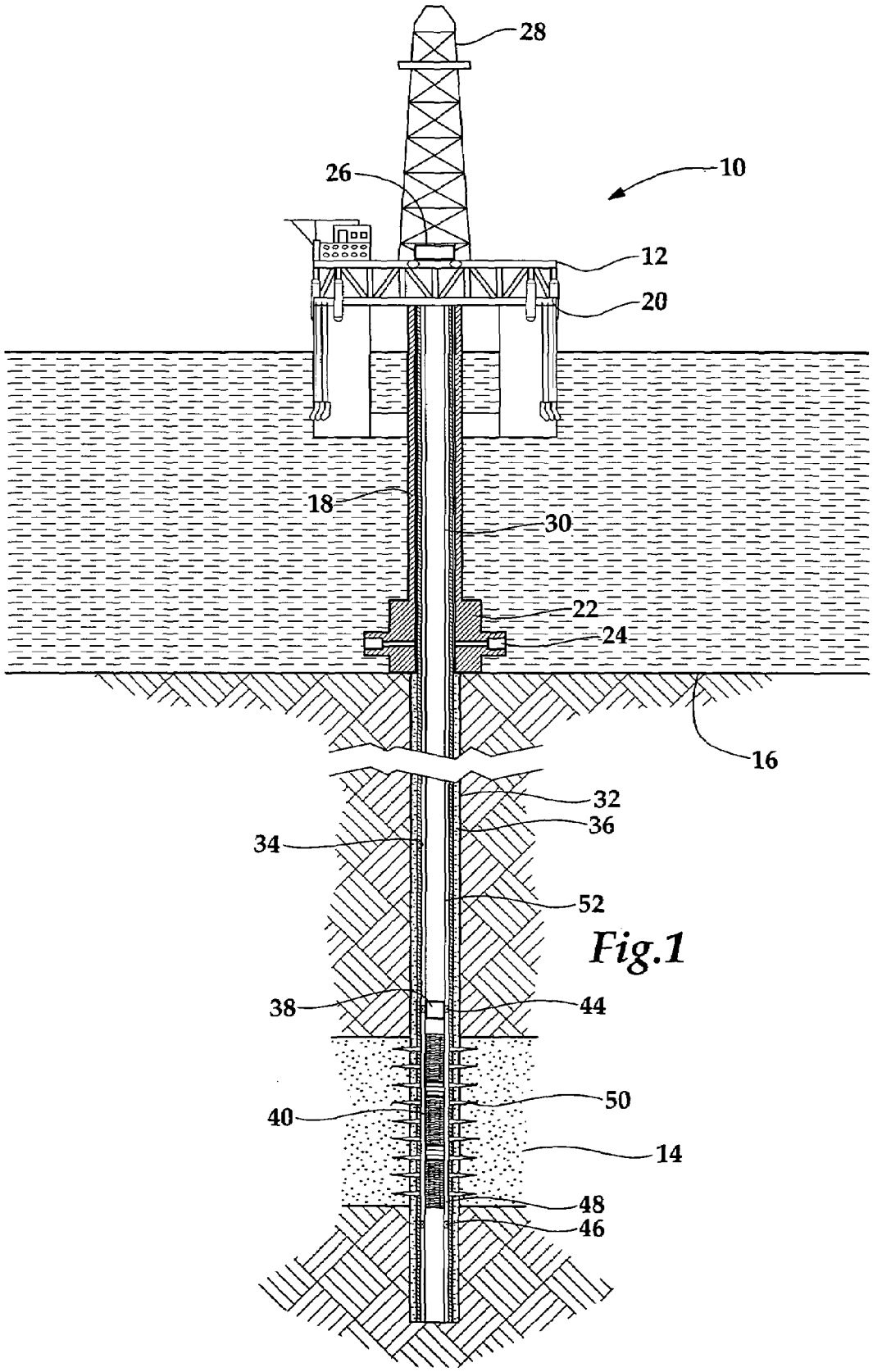
FIG. 1 is a schematic illustration of an offshore oil and gas platform during a gravel packing operation wherein a system for monitoring downhole conditions according to the present invention is being utilized.

Referring initially to FIG. 1, an offshore oil and gas platform during a gravel packing operation wherein a system for monitoring downhole conditions is being utilized according to the present invention is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. Work string 30 includes various tools including a cross-over assembly 38, a sand control screen assembly 40 and packers 44, 46 which define an annular region 48. When it is desired to gravel pack annular region 48, work string 30 is lowered through casing 34 until sand control screen assembly 40 is positioned adjacent to formation 14 including perforations 50. Thereafter, a fluid slurry including a liquid carrier and a particulate material such as gravel is pumped down work string 30.

During this process, the fluid slurry exits work string 30 through cross-over assembly 38 such that the fluid slurry enters annular region 48. Once in annular region 48, the gravel portion of the fluid slurry is deposited therein. Some of the liquid carrier may enter formation 14 through perforations 50 while the remainder of the fluid carrier can travel through sand control screen assembly 40 and cross-over assembly 38 to the surface in a known manner, such as through a wash pipe and into the annulus 52 above packer 44. The fluid slurry is pumped down work string 30 through cross-over assembly 38 until annular section 48 surrounding sand control screen assembly 40 is filled with gravel.

As will be explained in further detail hereinbelow, in order to monitor downhole conditions and, in particular, the integrity of the gravel pack, a plurality of transmission lines are associated with sand control screen assembly 40. Each of the transmission lines is in electrical communication with a time domain reflectometer, which is preferably disposed at the surface. The time domain reflectometer generates a transmission signal which travels through the transmission lines and the downhole medium surrounding the transmission lines at sand control screen assembly 40. The downhole medium, whether drilling mud, gas, water, sand, gravel, proppants, oil or the like, has electrical properties that effect a reflected signal which is returned to the time domain reflectometer. The electrical properties of the downhole medium may be analyzed or graphically represented in order to describe and monitor the electromagnetic profile of the constituents of the downhole medium about sand control screen assembly 40.

Even though FIG. 1 depicts a vertical well, it should be noted by one skilled in the art that the apparatus for monitoring downhole conditions of the present invention is equally well-suited for use in deviated wells, inclined wells or horizontal wells. Also, even though FIG. 1 depicts an offshore operation, it should be noted by one skilled in the art that the apparatus for monitoring downhole conditions of the present invention is equally well-suited for use in onshore operations or other types of offshore operations, such as those involving jackup rigs.

In addition, it should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Figure 2:
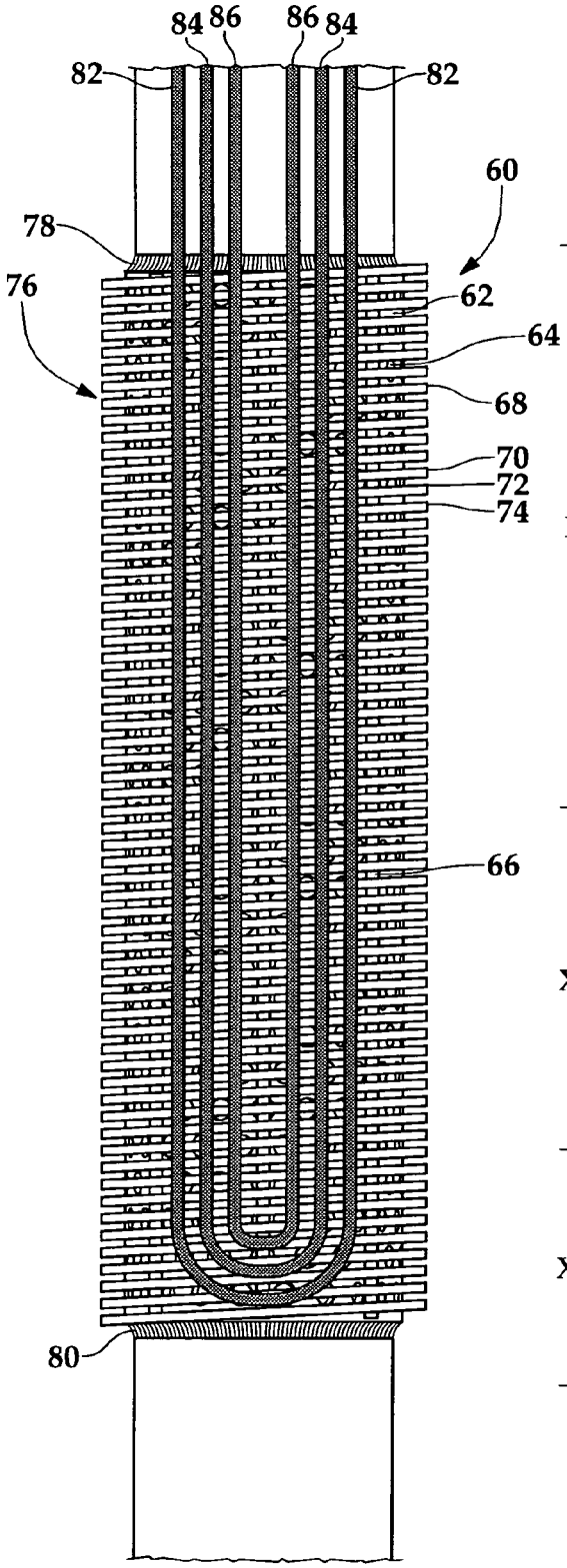
FIG. 2 is a side view of a sand control screen having transmission lines positioned thereon for monitoring downhole conditions according to the present invention.

Referring now to FIG. 2, therein is depicted a sand control screen according to the teachings of the present invention that is generally designated 60. Sand control screen 60 includes a base pipe 62 that has a plurality of openings 64 which allow the flow of production fluids into the production tubing. The exact number, size and shape of openings 64 are not critical to the present invention, so long as sufficient area is provided for fluid production and the integrity of base pipe 74 is maintained.

Spaced around base pipe 62 is a plurality of ribs 66. Ribs 66 are generally symmetrically distributed about the axis of base pipe 62. Ribs 66 are depicted as having a cylindrical cross section, however, it should be understood by one skilled in the art that the ribs may alternatively have a rectangular or triangular cross section or other suitable geometry. Additionally, it should be understood by one skilled in the art that the exact number of ribs will be dependant upon the diameter of base pipe 62 as well as other design characteristics that are well known in the art.

Wrapped around ribs 66 is a screen wire 68. Screen wire 68 forms a plurality of turns, such as turn 70, turn 72 and turn 74. Between each of the turns is a gap through which formation fluids flow. The number of turns and the gap between the turns are determined based upon the characteristics of the formation from which fluid is being produced and the size of the gravel to be used during the gravel packing operation. Together, ribs 66 and screen wire 68 may form a sand control screen jacket 76 which is attached to base pipe 62 at welds 78, 80 or by other suitable technique.

Transmission lines may be utilized in association with sand control screen jacket 60 to monitor the downhole conditions therearound. As illustrated, transmission lines 82, 84, 86 are being employed in conjunction with sand control screen 60 to monitor, for example, the integrity of a gravel pack during both completion and production phases of well operations. As illustrated, transmission lines 82, 84, 86 form three U-shapes. Although FIG. 2 depicts transmission lines 82, 84, 86 as being positioned exteriorly of sand control screen jacket 76, it should be understood by those skilled in the art that the transmission lines used to determine downhole conditions of the present invention may alternatively be positioned in other locations relative to a downhole tubular such as between a filter medium and an outer tubular or to the exterior of an outer shroud of a sand control screen. Likewise, the transmission lines of the present invention may be used in conjunction with other types of tubular members such as tubing, casing, drill pipe, line pipe, mandrels or other types of pipe as well as other non tubular downhole equipment. Further, it should be appreciated that although three transmission lines are illustrated in FIG. 2, the present invention may be practiced with any number of transmission lines. Also, it should be noted that the transmission lines may be wire such as copper or stainless steel wire, control lines such as hydraulic fluid control lines, optic fiber or other conductor suitable for transmission of electromagnetic signals.

Figure 3:
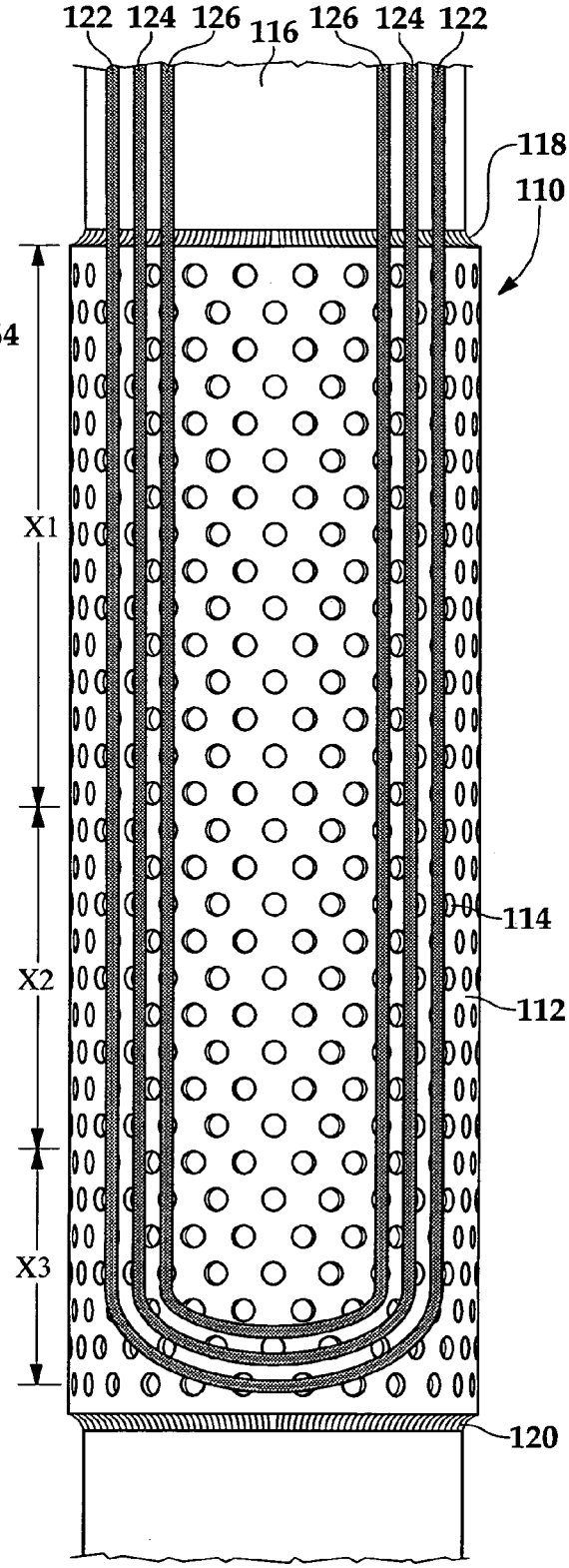
FIG. 3 is a side view of a sand control screen having transmission lines positioned thereon for monitoring downhole conditions according to the present invention.

Referring now to FIG. 3, therein is depicted a sand control screen according to the teachings of the present invention that is generally designated 110. Sand control screen 110 includes an outer shroud 112 having openings 114. It should be noted by those skilled in the art that even though FIG. 3 has depicted openings 114 as being circular, other shaped openings may alternatively be used without departing from the principles of the present invention. In addition, the exact number, size and shape of openings 114 are not critical to the present invention, so long as sufficient area is provided for fluid production therethrough and the integrity of outer shroud 112 is maintained. Positioned within an outer shroud 112 is a filter medium such as a fluid-porous, particulate restricting, filter medium formed from a plurality of layers of a wire mesh that are sintered or diffusion bonded together to form a porous wire mesh screen designed to allow fluid flow therethrough but prevent the flow of particulate materials of a predetermined size from passing therethrough. The filter medium is positioned around a perforated base pipe 116. Outer shroud 112 is attached to base pipe 116 at welds 118, 120.

Three transmission lines 122, 124, 126 are coupled to outer shroud 112 and form U-shaped patterns thereon. In the illustrated embodiment, transmission line 124 is positioned between transmission line 122 and transmission line 126. Preferably, transmission line 124 is positioned approximately equidistance from transmission line 122 and transmission line 126. As one skilled in the art will appreciate, the symmetrical and even spacing between transmission lines 122 and 124 and between transmission lines 124 and 126 enables the transmission lines 122, 124, 126 to better detect impedance mismatches in the constituent materials that define the downhole conditions being measured by time domain reflectometry.

In general, time domain reflectometry involves feeding an impulse of energy into the system under test, e.g., the downhole environment surrounding outer shroud 112, and observing the reflected energy at the point of insertion. When the fast-rise input pulse meets with a discontinuity or other electromagnetic mismatch, the resultant reflections appearing at the feed point are compared in phase and amplitude with the original pulse. By analyzing the magnitude, deviation and shape of the reflected signal, the nature of the electromagnetic variation in the system under test can be determined. Additionally, since distance is related to time and the amplitude of the reflected signal is directly related to impedance, the analysis yields the distance to the electromagnetic variation as well as the nature of the fault.

More specifically, electromagnetic waves traveling through the transmission lines are reflected at locations where changes in an electromagnetic characteristic, such as impedance, exist. By way of example, lengths $X_1$, $X_2$ and $X_3$ are characterized by impedances $Z_1$, $Z_2$ and $Z_3$, respectively. In operation, any electromagnetic wave moving from the length of line $X_1$ to the length of line $X_2$ will be reflected at the interface of $X_1$ and $X_2$. The reflection coefficient, ρ, of this reflection can be expressed as follows:

$$\rho=(Z_2-Z_1)/(Z_2+Z_1)$$

The transmission coefficient, τ, for a wave traveling from section $X_1$ to section $X_2$ is provided by the following equation:

$$\tau=2Z_2/(Z_2+Z_1)$$

If the incident wave has an amplitude, $A_i$, the reflected and transmitted waves have the following amplitudes:

$$A_r=\rho A_i \text{ and } A_t=\tau A_i$$

$A_r$ and $A_t$ are the amplitudes of the reflected and transmitted waves, respectively. Those skilled in the art will appreciate that similar equations may be derived for the interface of $X_2$ and $X_3$. Further, it will be understood that the impedances $Z_1$, $Z_2$ and $Z_3$ change in response to the varying composition and, in particular, oil, water and gas composition, within lengths $X_1$, $X_2$ and $X_3$.

In addition to the amplitudes of the reflected and transmitted waves, the propagation velocity of the electromagnetic wave that travels through the downhole medium as it propagates through transmission lines 122, 124, 126 is of interest in time domain reflectometry. Continuing with the example illustrated in FIG. 3, transmission lines 122, 124, 126 will contact physical discontinuities at the interface of $X_1$ and $X_2$ as well as at the interface of $X_2$ and $X_3$, such that the physical discontinuities are separated by a distance $X_2$. The time that a reflection from the discontinuity at interface $X_1$–$X_2$ arrives at the time domain reflectometer may be designated $T_1$ and the time that the reflection from the discontinuity at interface $X_2$–$X_3$ arrives at the time domain reflectometer may be designated $T_2$, such that the propagation velocity, V, may be expressed as:

$$V=2X_2/(T_2-T_1)$$

By normalizing the propagation velocity to the speed of light, c, the apparent dielectric constant, $K_a$, of the downhole medium surrounding transmission lines 122, 124, 126 over distance $X_2$ may be expressed as follows:

$$K_a=(c/V)^2$$

The apparent dielectric constant of the downhole medium is related to the amount of oil, water, sand, gas, gravel and proppants, for example, present in the downhole medium. In one implementation, an expert system based upon empirical data may be utilized to determine the constituent materials of a downhole medium corresponding to a measured apparent dielectric constant.

These equations or similar equations are utilized to determined the downhole conditions when the transmission signal is generated at a time domain reflectometer and propagated through transmission lines 122, 124, 126 associated with the tubular that is positioned in the downhole medium. Transmission lines 122, 124, 126 may be utilized independently in different configurations to propagate the signal. Transmission lines 122, 124, 126 and outer shroud 112 assist the propagation of the signal by forming a waveguide that effectuates the characteristics of a coaxial cable. In one implementation, the outer transmission lines 122, 126, provide shielding and the central transmission line 124 provides a central conductor. In another implementation, outer shroud 112 provides the shielding and one or more of transmission lines 122, 124, 126 provide a central conductor. It should appreciated that transmission lines 122, 124, 126 that are not being used as either conductors or shielding may be disconnected to reduce noise interference. In any of the above-mentioned implementations, the transmission signal is reflected in response to the electromagnetic profile of the downhole medium and, in particular, in response to an impedance change in the downhole medium caused by a change in the electromagnetic profile of the constituents of the downhole medium. The reflected signals are received at the time domain reflectometer and analyzed using the equations discussed hereinabove to determine the downhole conditions.

Figure 4:
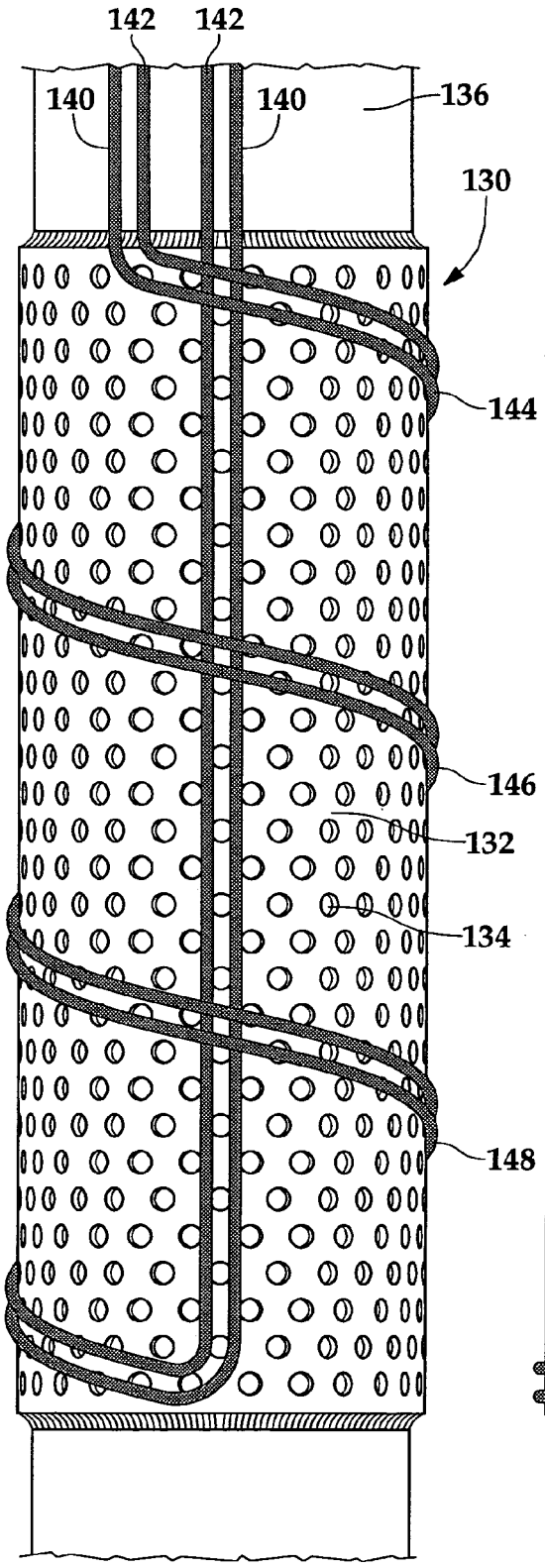
FIG. 4 is a side view of a sand control screen having another embodiment of the transmission lines positioned thereon for monitoring downhole conditions according to the present invention.

Referring now to FIG. 4, therein is depicted a sand control screen of the present invention that is generally designated 130. Sand control screen 130 has an outer shroud 132 having openings 134 that is positioned around a filter medium (not pictured) both of which are mounted to a perforated base pipe 136. Two transmission lines 140, 142 are coupled to outer shroud 132 to form a substantially helical pattern which includes turns 144, 146, 148. It should be appreciated that the transmission lines 140, 142 may be coupled to a conventional sand control screen without negatively impacting the functions of the sand control screen. Like transmission lines 122, 124, 126 of FIG. 3, preferably transmission lines 140, 142 maintain approximately a uniform distance from one another to provide a two-wire waveguide. The distance between turns is appropriately greater than the distance between transmission lines in order to avoid crosstalk or other electromagnetic phenomena between adjacent helical loops which may adversely affect the time domain reflectometry measurements. Further, the helical pattern, which may include more or less turns, provides 360° coverage around sand control screen 130, thereby providing complete visibility into the conditions which surround sand control screen 130. In particular, the present invention provides great resolution and depth penetration while simultaneously offering high measurement precision. Moreover, the electromagnetic waves traverse the transmission lines quickly to provide real time resolution of the downhole conditions.

Figure 5:
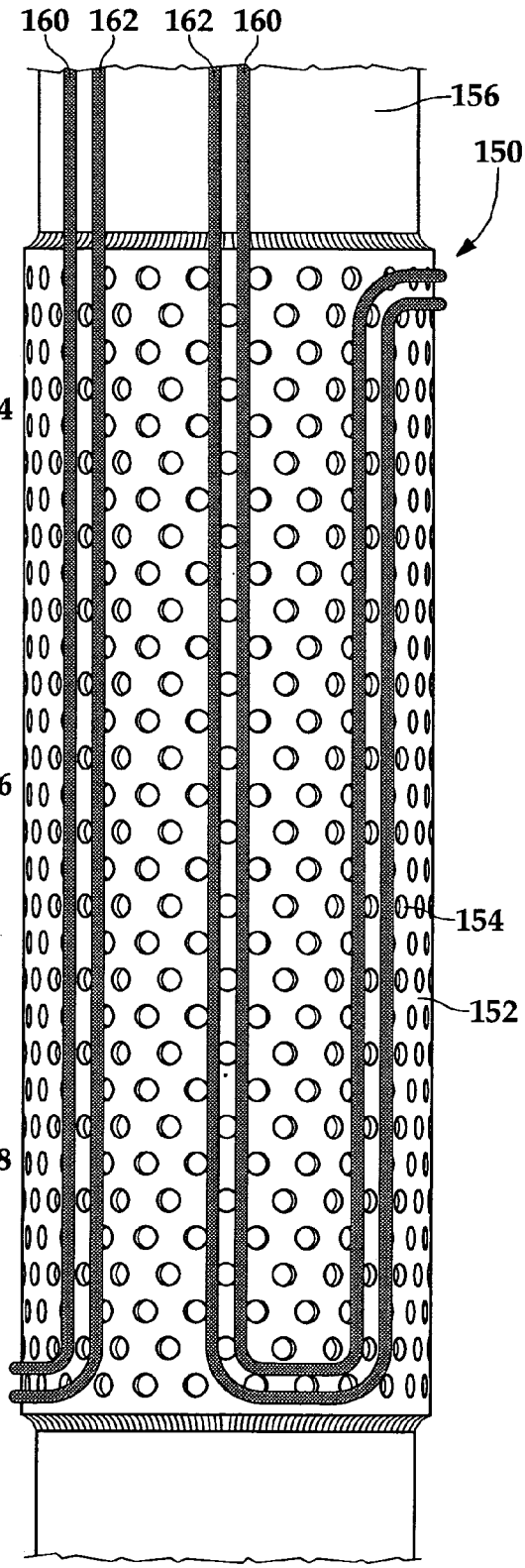
FIG. 5 is a side view of a sand control screen having a further embodiment of the transmission lines positioned thereon for monitoring downhole conditions according to the present invention.

Referring now to FIG. 5, therein is depicted a sand control screen of the present invention that is generally designated 150. Sand control screen 150 has an outer shroud 152 having openings 154 that is positioned around a filter medium (not pictured) both of which are mounted to a perforated base pipe 156. Two transmission lines 160, 162 are coupled to outer shroud 152 and traverse outer shroud 152 multiple times. For example, transmission lines 160, 162 traverse outer shroud 152 forming a plurality of loops that provide real time resolution of downhole conditions and 360° coverage around outer shroud 152. The distance between loops is greater than the distance between transmission lines 160, 162. It should be appreciated, that although particular implementations of the transmission lines have been depicted in FIGS. 3–5, other implementations are within the teachings of the present invention. Moreover, the transmission lines described herein may be utilized during completion operations, production operations and the like. For example, the transmission lines may be utilized during a completion operation to ensure a complete gravel pack having no voids. By way of another example, the transmission lines may be utilized during a production operation to enhance production by determining the location of water production such that certain production intervals or regions within a production interval may be shut off.

Figure 6:
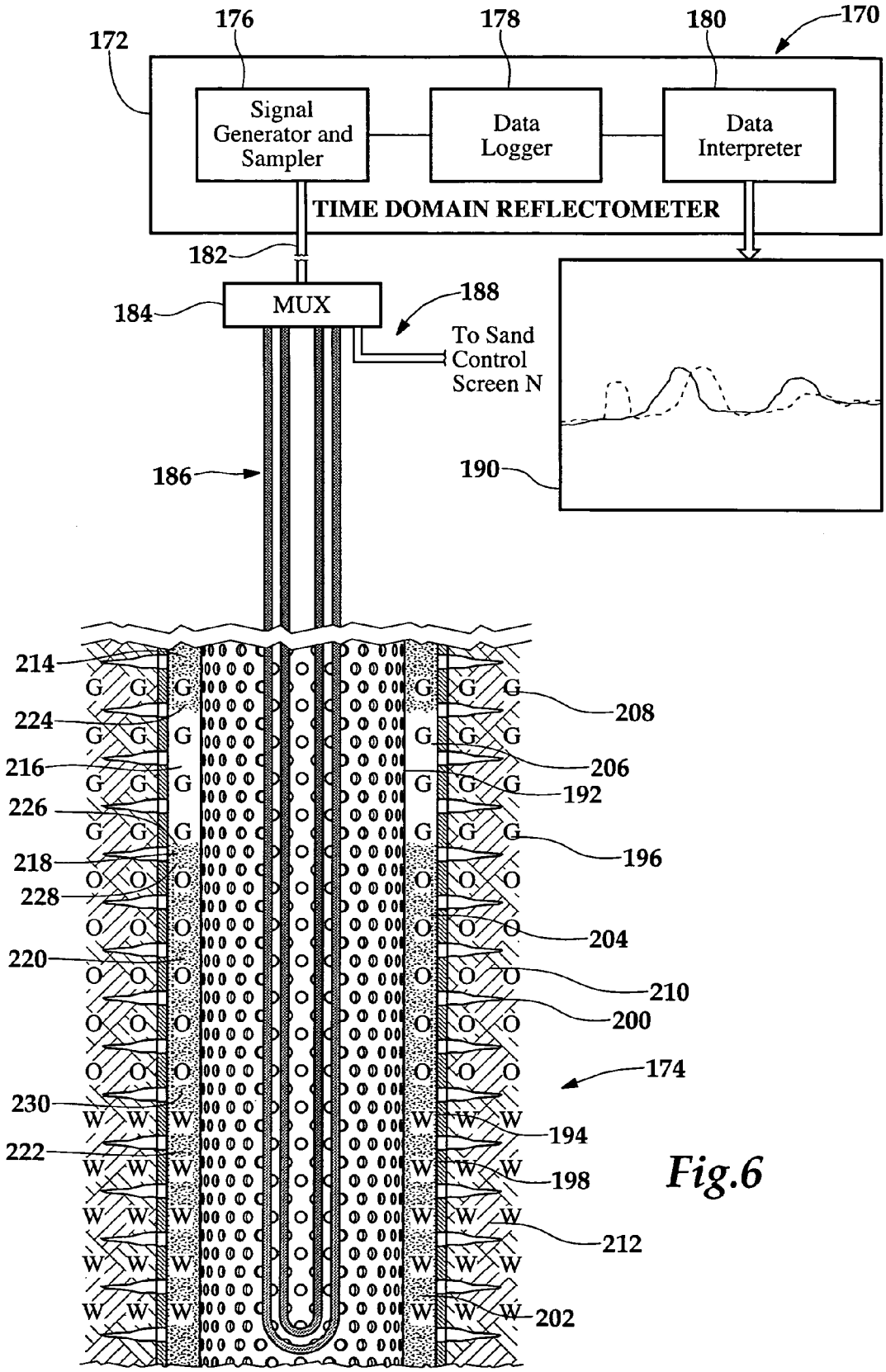
FIG. 6 depicts a system for monitoring downhole conditions according to the present invention.

FIG. 6 depicts a system for monitoring downhole conditions according to the present invention that is generally designated 170. System 170 includes a time domain reflectometer 172 that generates electromagnetic pulses or signals, such as electrical, optical or other signal types within the electromagnetic spectrum, and receives reflections of the electromagnetic signals. Time domain reflectometer 172 may be temporarily or permanently positioned at a surface location, a downhole location or other remote location such that a one time survey or series of surveys may be performed to determine downhole conditions in a system under test, which is a downhole environment 174 in FIG. 6. In a preferred embodiment, time domain reflectometer 172 includes a signal generator and sampler 176, a datalogger 178 and a data interpreter 180. For example, the time domain reflectometer 172 may comprise a step generator and an oscilloscope. In one embodiment, signal generator and sampler 176 is a digital device that generates a very short rise time electromagnetic pulse that is applied to a coaxial conveyance 182 which is coupled to a multiplexer 184 which increases the number of transmission lines that may be employed with time domain reflectometer 172. It should be appreciated, however, that time domain reflectometer 172 may comprise any combination of hardware, software and firmware.

As illustrated, transmission line sets 186 and 188 are coupled to multiplexer 184, which in a presently preferred exemplary embodiment, may comprise a time domain multiplexer. Although only two sets of transmission lines are depicted connected to multiplexer 184, it should be understood that any number of sets of transmission lines may be coupled to multiplexer 184 depending upon the number of independent downhole surveys desired. Also, it should be understood that multiple sets of independent transmission lines may be associated with the same system under test 174 through multiplexer 184 such that results from the independent systems can be compared to one another. Use of such independent transmission lines is one way to make alterations in end point characteristics of the transmission lines as will be discussed in greater detail in association with FIGS. 7 and 8 below. In the illustrated embodiment, after sending the pulse which may be input into either end of a transmission line, signal generator and sampler 176 samples and digitizes the reflected signals which are stored by datalogger 178 and analyzed by data interpreter 180. Preferably, data interpreter 180 is operable to produce graphical representations, such as graph 190, of the data collected and interpreted. As previously discussed, the elapsed travel time and pulse reflection amplitude contain information used by an engineer, a computer system or an expert system, for example, to quickly and accurately determine the water content, bulk electrical conductivity or other user-specific, time domain measurement.

In system under test 174, a sand control screen assembly 192 is disposed in a wellbore 194 proximate formation 196. Wellbore 194 includes a casing 198 having perforations 200 that provide for fluid communication between formation 196 and production tubing (not illustrated) which is associated with sand control screen assembly 192. As illustrated, an annulus 202 is defined between casing 198 and sand control screen 192. The completion of wellbore 194 includes a gravel pack 204 that prevents the production of particulates from formation 196. As illustrated, transmission line set 186 is positioned within annulus 202 and in direct contact with the downhole medium of gravel pack 204. Alternatively, transmission line set 186 could be located within the outer shroud or even within the filter medium of sand control screen assembly 192 in which case transmission line set 186 may not directly contact gravel pack 204 but will nonetheless be influenced by the electromagnetic properties of the downhole medium, and will accordingly be considered to operably contact the downhole medium. In the illustrated embodiment, gravel pack 204 has irregularities, however, including a region having a void 206. In addition, formation 196 includes regions that are producing different fluids. Specifically, formation 196 has a region 208 producing gas G, a region 210 producing oil O and a region 212 producing water W. Due to the production profile of the formation 196, the downhole environment surrounds sand control screen 192 has a variety of conditions.

In the illustrated embodiment, the uppermost region 214 within annulus 202 has a combination of gravel pack 204 and gas G. The next lower region 216 is a gas G only environment as the gravel pack in region 216 has failed. Another gravel pack 204 and gas G environment is found in region 218. The next region 220 within annulus 202 is a gravel pack 204 and oil O environment. The lower most region 222 is a gravel pack 204 and water W environment. The electromagnetic properties within the various regions 214, 216, 218, 220, 222 will be determined by the specific constituents that define the environments therein. In addition, boundaries or interphase regions exist between the various regions 214, 216, 218, 220, 222. Specifically, interphase region 224 exists between regions 214, 216, interphase region 226 exists between regions 216, 218, interphase region 228 exists between regions 218, 220 and interphase region 230 exists between regions 220, 222.

As previously discussed, a transmission signal is propagated through transmission lines 186 and reflected in response to the electromagnetic profile of the downhole medium surrounding sand controls screen 192. In particular, the transmission signal is reflected in response to the impedance changes in the downhole medium in regions 214, 216, 218, 220, 222 and at interfaces 224, 226, 228, 230. The reflected signals are received at time domain reflectometer 172, stored in data logger 178 and analyzed using data interpreter 180 to produce graphical representation 190. The analysis may involve comparing the reflected signal to a control waveform or comparing the reflected signal to the transmission signal. Further, to improve the signal to noise ratio, the analysis may involve averaging the measurements provided by several reflected signals.

In instances where an incomplete gravel pack is present, the electromagnetic profile of the downhole medium may include a change in an electromagnetic property such as impedance, resistance, inductance or capacitance that corresponds to the location of the discontinuity in the gravel pack. Accordingly, the present invention provides a system and method for monitoring downhole conditions during a gravel packing operation to enhance the uniformity of gravel placement. The real time graphical representation 190 provides the necessary information to engineers or well operators so that appropriate corrective action may be taken. For example, if voids are detected during a gravel packing operation, then gravel packing parameters such as flow rate, viscosity and proppant concentration may be altered to alleviate the voids. By way of another example, if an undesirable condition such as water production or sand production is detected during a production operation, valves may be closed to isolate that region of the production interval.

Figure 7:
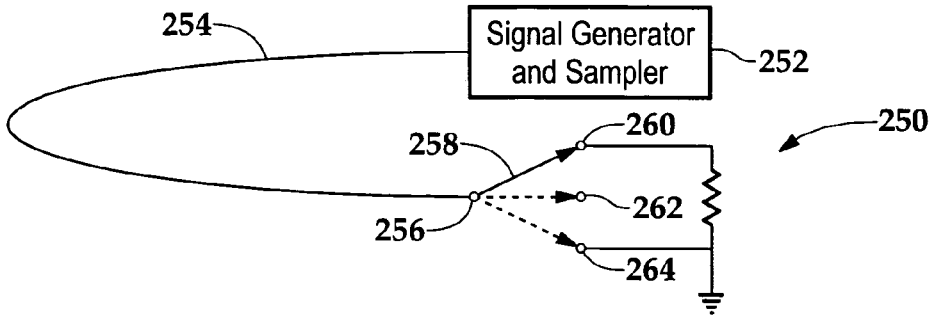
FIG. 7 depicts a schematic illustration of a pulse input and measurement circuit associated with a time domain reflectometer according to the present invention.

FIG. 7 depicts a pulse input and measurement circuit 250 associated with a time domain reflectometer, such as reflectometer 172 of FIG. 6. The circuit 250 includes a signal generator and sampler 252 and a transmission line 254 having an end point 256. A switch 258 is located at end point 256 that is operable to alter the electrical characteristics of end point 256. Specifically, switch 258 provides three positions; namely a finite load position 260, an infinite load or open circuit position 262 and a ground or closed circuit position 264. By propagating signals, preferably short rise time pulses in the 10–10,000 nanosecond range, through transmission line 254 and monitoring the reflection of the signals from the end point 256, characteristics of transmission line 254 and its surroundings can be determined. For example, the velocity of the signals propagating through transmission line 254 can be used to determine electromagnetic characteristics in the medium surrounding transmission line 254. The velocity of the signals can be determined by monitoring the reflections from end point 256 of transmission line 254 with signal generator and sampler 252 when switch 258 is in its various positions 260, 262, 264.

Figure 8:
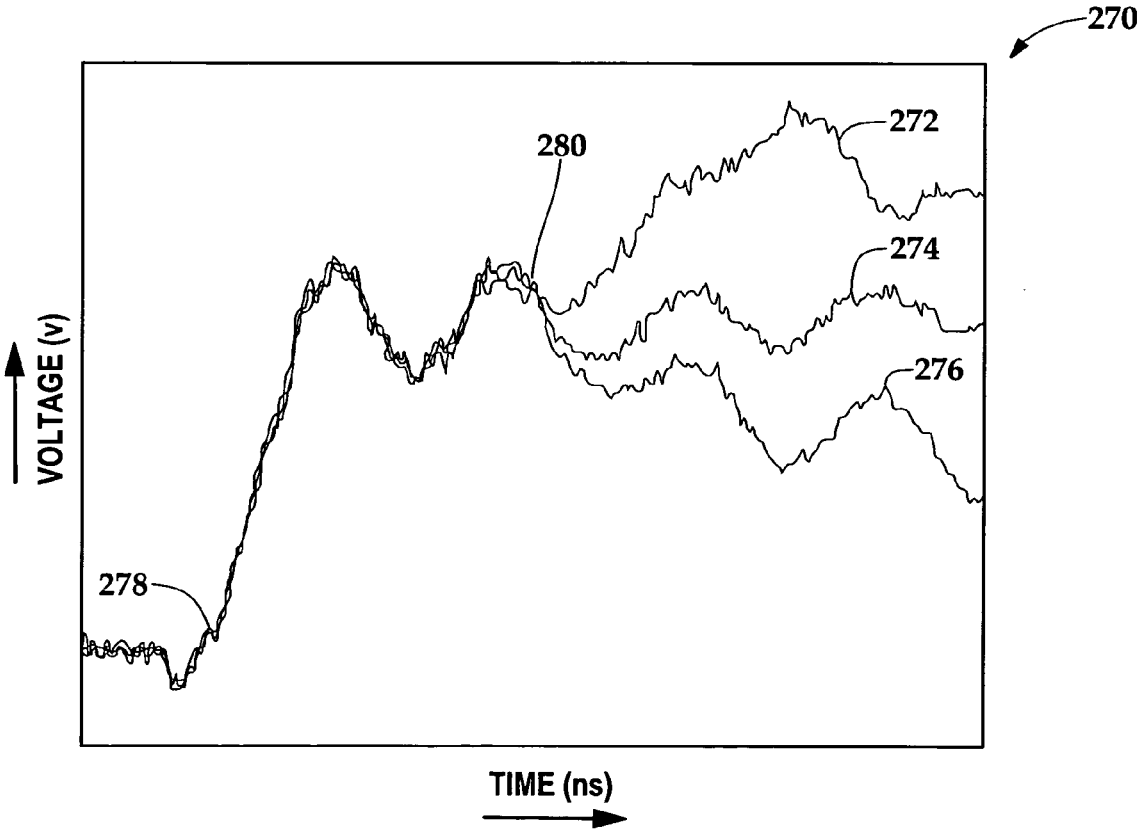
FIG. 8 depicts a plot of voltage versus time that is associated with the schematic circuit illustration of FIG. 7.

FIG. 8 depicts a plot 270 of voltage versus time that is associated with the circuit 250 of FIG. 7. In the plot, voltage is expressed in volts (v) and time is expressed in nanoseconds (ns). Waveform 272 is associated with open position 262 of switch 258 of circuit 250. Similarly, waveform 274 is associated with finite load position 260 and waveform 276 is associated with closed position 264. Point 278 on waveforms 272, 274, 276 represents the time at which the signals enter transmission line 254. Point 280 on the waveforms 272, 274, 276 represents the time at which the signals reach end point 256. More specifically, due to the difference in end point characteristics created by switch 258, an end point disturbance is created that differentiates the reflections received from end point 256. Due to the differences in the reflected waveforms, the location of end point 256 can be identified which in turn allows for the identification of other parameters such as the velocity of the signals.

Figure 9:
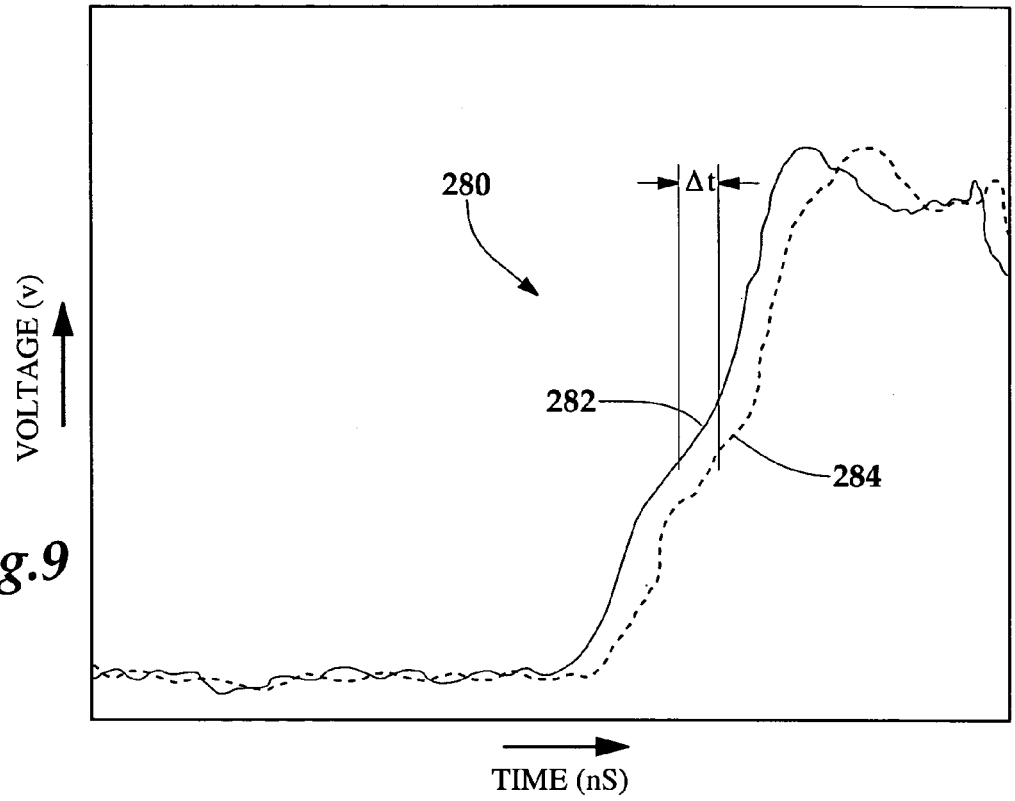
FIG. 9 depicts a plot of voltage versus time wherein downhole conditions are graphically represented.

FIG. 9 depicts a plot 280 of voltage versus time wherein downhole conditions within a gravel pack completion are graphically represented. In the plot, voltage is expressed in volts (v) and time is expressed in nanoseconds (ns). The time domain reflectometry teachings of the present invention were utilized to produce a control waveform 282 and a waveform 284. Control waveform 282 represents a control signal produced by previous empirical testing that is representative of the gravel pack under known or previous conditions. In one embodiment, waveform 282 is created by subtracting a waveform generated by propagating a signal through a transmission line disposed in the downhole gravel pack medium with an end point having a closed circuit from a waveform generated by a signal propagated through the transmission line disposed in the downhole gravel pack medium with an end point having an open circuit. Use of such a subtraction waveform aids in illustrating the principles of the present invention. In the illustrated embodiment, waveform 284, also an open circuit minus closed circuit subtraction waveform, represents the electromagnetic profile of the system under test (SUT) at a time after the control condition, for example, after production has commenced into the gravel pack completion. As depicted, a phase shift is present between waveform 284 and the control waveform 282. Specifically, waveform 284 is delayed in time, $\Delta t$, which indicates the velocity of the signal propagating through the transmission line in the downhole medium after production is less than the velocity of the signal in the downhole medium before production. Under this one particular set of downhole conditions, the illustrated phase shift is indicative of the presence of oil production through the gravel pack at a particular location in the downhole medium. This determination can be made using software tools such as expert systems or neural networks, for example.

Figure 10:
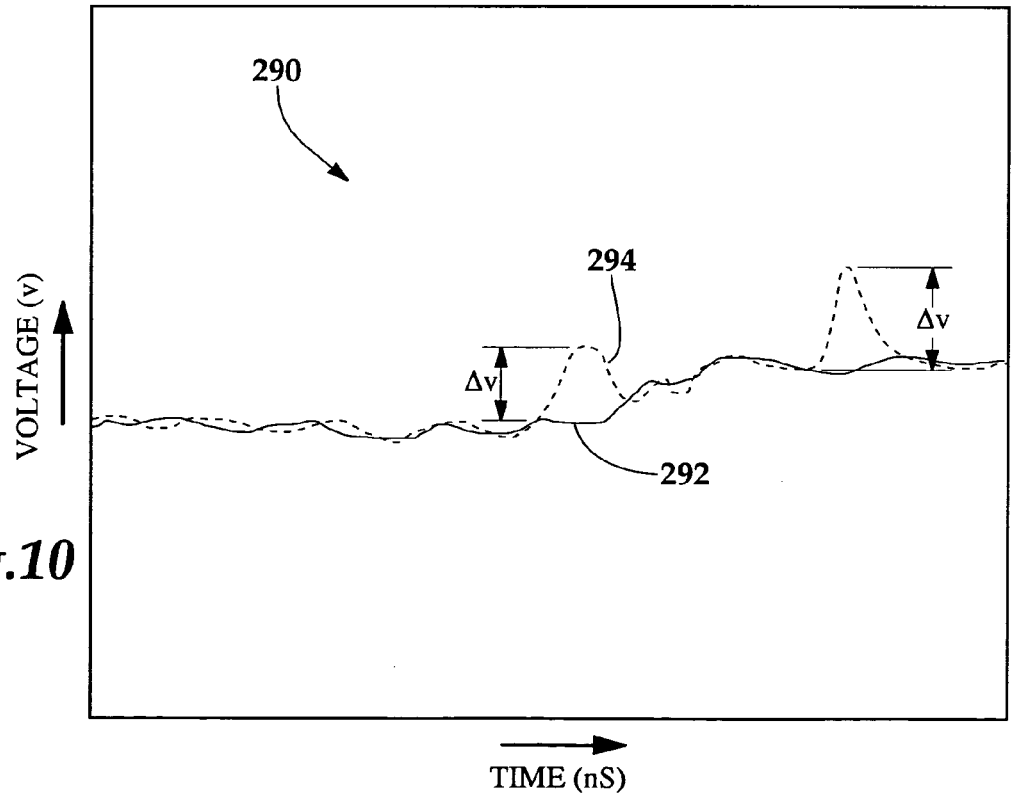
FIG. 10 depicts another plot of voltage versus time wherein downhole conditions are graphically represented.

FIG. 10 depicts another embodiment of a plot 290 of voltage versus time wherein downhole conditions are graphically represented. Specifically, waveform 294 represents two reflected signals sampled by a time domain reflectometer of the present invention processed using the subtraction technique described above. Waveform 294 has two instances of increased amplitude when compared to control waveform 292. Under one particular set of downhole conditions, the increased amplitudes are indicative of the presence of voids in the gravel pack at two particular locations in the downhole medium. Further, it should be appreciated that the distance to the electromagnetic variations or discontinuities may be determined based on the location of the discontinuity on the time axis of plot 290 since the propagation velocity may be approximated as discussed hereinabove.

Figure 11:
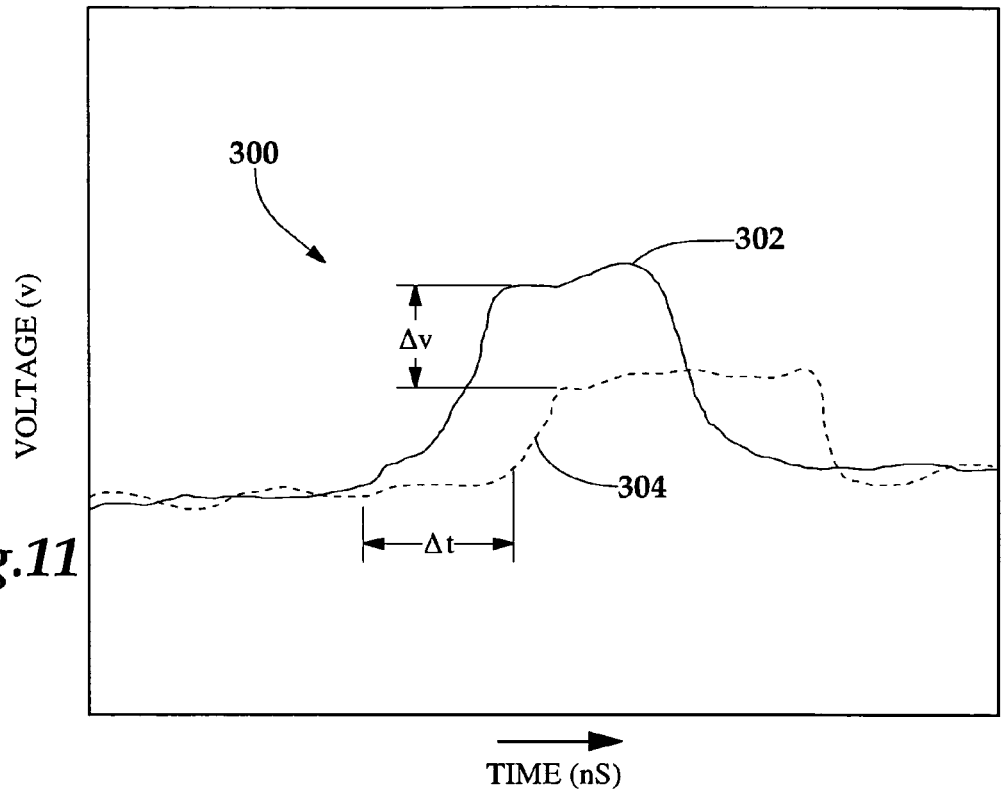
FIG. 11 depicts a further plot of voltage versus time wherein downhole conditions are graphically represented.

FIG. 11 depicts a further embodiment of a plot 300 of voltage versus time wherein downhole conditions are graphically represented. Similar to the previous plots of FIGS. 9 and 10, waveform 304 represents two reflected signals sampled by the time domain reflectometer of the present invention and processed using the subtraction technique described above and control waveform 302 represents a control. As illustrated, when compared to control waveform 302, waveform 304 is phase shifted. Additionally, waveform 304 includes a reduced magnitude. Under one set of downhole conditions, the phase shifting and reduced magnitude may be indicative of the presence of water in the gravel pack around the sand control screen apparatus.

Figure 12:
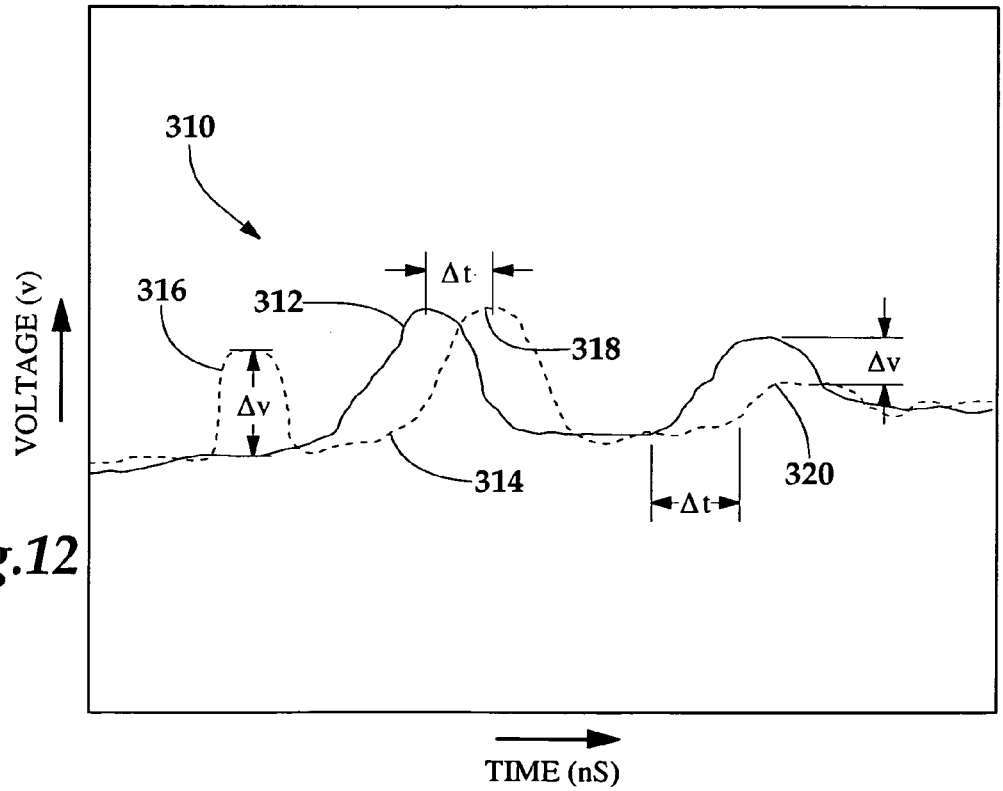
FIG. 12 depicts yet another plot of voltage versus time wherein downhole conditions are graphically represented.

FIG. 12 depicts another embodiment of a plot 310 of voltage versus time wherein downhole conditions of a gravel pack are graphically represented. When compared to control waveform 312, a waveform 314 produced by the time domain reflectometry teachings of the present invention includes a region 316 of increased amplitude, a region 318 of phase delay and a region 320 of reduced amplitude and phase delay. Referring also now to FIG. 6, region 316 of increased amplitude corresponds to region 216 of FIG. 6 wherein a void has developed in gravel pack 204 and the fluid being produced therethrough is gas G. Similarly, region 318 of plot 310 corresponds to region 220 of FIG. 6 wherein oil O is being produced through gravel pack 204. Likewise, region 320 of plot 310 corresponds to region 222 of FIG. 6 wherein water W is being produced through gravel pack 204. Hence, the present invention provides a well operator real time information regarding the distribution of various constituent materials along a tubular, such as sand control screen 192, that translates into knowledge about the effectiveness of a gravel pack as well as the production profile of formation 196.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A system for determining downhole conditions comprising:

a time domain reflectometer operable to generate a short rise time electromagnetic pulse transmission signal and receive a reflected signal;

a tubular operably positioned downhole in a downhole medium; and a waveguide operably contacting the downhole medium and in communication with the time domain reflectometer, the waveguide operable to propagate the transmission signal and operable to propagate the reflected signal generated responsive to an electromagnetic property of the downhole medium.

2. The system as recited in claim 1 wherein the waveguide further comprises at least one transmission line.

3. The system as recited in claim 2 wherein the transmission line has a distal end and wherein electrical characteristics of the distal end are altered to alter characteristics of the reflected signal from the distal end.

4. The system as recited in claim 1 wherein the transmission signal is selected from the group consisting of electrical pulses and optic pulses.

5. The system as recited in claim 1 wherein the time domain reflectometer samples and digitizes the reflected signal.

6. The system as recited in claim 1 wherein the time domain reflectometer further comprises a step generator and an oscilloscope.

7. The system as recited in claim 1 wherein the time domain reflectometer further comprises a signal generator and sampler, a datalogger and a data interpreter.

8. The system as recited in claim 1 wherein the tubular is selected from the group consisting of sand control screens, outer shrouds, tubing, casing and pipes.

9. The system as recited in claim 1 wherein the downhole medium includes constituents selected from the group consisting of water, gas, sand, gravel, proppants and oil.

10. The system as recited in claim 1 wherein the system is operational during well completion and well production operations.

11. The system as recited in claim 1 wherein the time domain reflectometer provides a profile of the downhole medium based upon amplitude and phase of the reflected signal.

12. The system as recited in claim 1 wherein the time domain reflectometer provides a profile of the downhole medium by comparing the reflected signal to a control waveform.

13. The system as recited in claim 1 wherein the electromagnetic property of the downhole medium is selected from the group consisting of impedance, resistance, inductance and capacitance.

14. A method for determining downhole conditions comprising the steps of:

generating a transmission signal;

propagating the transmission signal through a transmission line operably contacting a downhole medium;

reflecting the transmission signal in response to an electromagnetic property of the downhole medium;

receiving the reflected signal; and analyzing the reflected signal to determine at least one downhole condition by comparing the reflected signal to a control waveform.

15. The method as recited in claim 14 wherein the step of generating the transmission signal further comprises generating a short rise time electromagnetic pulse signal selected from the group consisting of electrical pulses and optical pulses.

16. The method as recited in claim 14 wherein the step of propagating the transmission signal through a transmission line further comprises associating the transmission line with a tubular selected from the group consisting of sand control screens, outer shrouds, tubing, casing and pipes.

17. The method as recited in claim 14 wherein the step of reflecting the transmission signal further comprises encountering a constituent selected from the group consisting of water, gas, sand, gravel, proppants and oil.

18. The method as recited in claim 14 wherein the step of receiving the reflected signal further comprises sampling and digitizing the reflected signal.

19. The method as recited in claim 14 wherein the step of analyzing the reflected signal further comprises analyzing amplitude and phase of the reflected signal.

20. The method as recited in claim 14 wherein the step of generating the transmission signal further comprises generating the transmission signal during a wellbore operation selected from the group consisting of completion operations and production operations.

21. The method as recited in claim 14 further comprising altering electrical characteristics of a distal end of the transmission line to alter characteristics of the reflected signal from the distal end.

22. The method as recited in claim 14 wherein the step of analyzing the reflected signal further comprising determining a change in an electromagnetic property of the downhole medium selected from the group consisting of impedance, resistance, inductance and capacitance.

23. An apparatus for determining downhole conditions comprising:

a tubular operably positioned in a downhole medium; and a waveguide operably contacting the downhole medium, the waveguide operable to propagate a transmission signal received from a time domain reflectometer and to propagate a reflected signal generated responsive to an electromagnetic property of the downhole medium, wherein the waveguide comprises first, second and third transmission lines such that the second transmission line is positioned substantially equidistantly between the first transmission line and the third transmission line and wherein the first, second and third transmission lines form U-shaped patterns.

24. The apparatus as recited in claim 23 wherein the tubular is selected from the group consisting of sand control screens, outer shrouds, tubing, casing and pipes.

25. The apparatus as recited in claim 23 wherein the downhole medium further comprises constituents selected from the group consisting of water, gas, sand, gravel, proppants and oil.

26. The system apparatus as recited in claim 23 wherein the electromagnetic property of the downhole medium is selected from the group consisting of impedance, resistance, inductance and capacitance.

27. A system for determining downhole conditions comprising:

a time domain reflectometer operable to generate a short rise time electromagnetic pulse transmission signal and sample a reflected signal;

a sand control screen assembly positioned in a downhole medium; and a waveguide operably contacting the downhole medium and in communication with the time domain reflectometer, the waveguide operable to propagate the transmission signal and operable to propagate the reflected signal generated responsive to an electromagnetic property of the downhole medium.

28. The system as recited in claim 27 wherein the downhole medium includes a constituent selected from the group consisting of water, gas, sand, gravel, proppants and oil.

29. The system as recited in claim 27 wherein the sand control screen is utilized in a wellbore operation selected from the group consisting of completion operations and production operations.

30. The system as recited in claim 27 wherein the time domain reflectometer provides a profile of the downhole medium based upon amplitude and phase of the reflected signal.

31. The system as recited in claim 27 wherein the time domain reflectometer provides a profile of the downhole medium by comparing the reflected signal to a control waveform.

32. The system as recited in claim 27 wherein the waveguide further comprises at least one transmission line.

33. The system as recited in claim 32 wherein the transmission line has a distal end and wherein electrical characteristics of the distal end are altered to alter characteristics of the reflected signal from the distal end.

34. The system as recited in claim 27 wherein the transmission signal is selected from the group consisting of electrical pulses and optic pulses.

35. The system as recited in claim 27 wherein the time domain reflectometer samples and digitizes the reflected signal.

36. The system as recited in claim 27 wherein the time domain reflectometer further comprises a step generator and an oscilloscope.

37. The system as recited in claim 27 wherein the time domain reflectometer further comprises a signal generator and sampler, a datalogger and a data interpreter.

38. The system as recited in claim 27 wherein the electromagnetic property of the downhole medium is selected from the group consisting of impedance, resistance, inductance and capacitance.

39. A system for determining downhole conditions comprising:

a time domain reflectometer operable to generate a transmission signal and receive a reflected signal;

a tubular operably positioned downhole in a downhole medium; and a waveguide operably contacting the downhole medium and in communication with the time domain reflectometer, the waveguide operable to propagate the transmission signal and operable to propagate the reflected signal generated responsive to an electromagnetic property of the downhole medium, wherein the system is operational during well completion and well production operations.

40. The system as recited in claim 39 wherein the waveguide further comprises at least one transmission line.

41. The system as recited in claim 40 wherein the transmission line has a distal end and wherein electrical characteristics of the distal end are altered to alter characteristics of the reflected signal from the distal end.

42. The system as recited in claim 39 wherein the transmission signal further comprises a short rise time electromagnetic pulse.

43. The system as recited in claim 39 wherein the transmission signal is selected from the group consisting of electrical pulses and optic pulses.

44. The system as recited in claim 39 wherein the time domain reflectometer samples and digitizes the reflected signal.

45. The system as recited in claim 39 wherein the time domain reflectometer further comprises a step generator and an oscilloscope.

46. The system as recited in claim 39 wherein the time domain reflectometer further comprises a signal generator and sampler, a datalogger and a data interpreter.

47. The system as recited in claim 39 wherein the tubular is selected from the group consisting of sand control screens, outer shrouds, tubing, casing and pipes.

48. The system as recited in claim 39 wherein the downhole medium includes constituents selected from the group consisting of water, gas, sand, gravel, proppants and oil.

49. The system as recited in claim 39 wherein the time domain reflectometer provides a profile of the downhole medium based upon amplitude and phase of the reflected signal.

50. The system as recited in claim 39 wherein the time domain reflectometer provides a profile of the downhole medium by comparing the reflected signal to a control waveform.

51. The system as recited in claim 39 wherein the electromagnetic property of the downhole medium is selected from the group consisting of impedance, resistance, inductance and capacitance.

52. A system for determining downhole conditions comprising:

a time domain reflectometer operable to generate a transmission signal and receive a reflected signal;

a tubular operably positioned downhole in a downhole medium; and a waveguide operably contacting the downhole medium and in communication with the time domain reflectometer, the waveguide operable to propagate the transmission signal and operable to propagate the reflected signal generated responsive to an electromagnetic property of the downhole medium, wherein the time domain reflectometer provides a profile of the downhole medium based upon amplitude and phase of the reflected signal.

53. The system as recited in claim 52 wherein the waveguide further comprises at least one transmission line.

54. The system as recited in claim 53 wherein the transmission line has a distal end and wherein electrical characteristics of the distal end are altered to alter characteristics of the reflected signal from the distal end.

55. The system as recited in claim 52 wherein the transmission signal further comprises a short rise time electromagnetic pulse.

56. The system as recited in claim 52 wherein the transmission signal is selected from the group consisting of electrical pulses and optic pulses.

57. The system as recited in claim 52 wherein the time domain reflectometer samples and digitizes the reflected signal.

58. The system as recited in claim 52 wherein the time domain reflectometer further comprises a step generator and an oscilloscope.

59. The system as recited in claim 52 wherein the time domain reflectometer further comprises a signal generator and sampler, a datalogger and a data interpreter.

60. The system as recited in claim 52 wherein the tubular is selected from the group consisting of sand control screens, outer shrouds, tubing, casing and pipes.

61. The system as recited in claim 52 wherein the downhole medium includes constituents selected from the group consisting of water, gas, sand, gravel, proppants and oil.

62. The system as recited in claim 52 wherein the system is operational during well completion and well production operations.

63. The system as recited in claim 52 wherein the time domain reflectometer provides a profile of the downhole medium by comparing the reflected signal to a control waveform.

64. The system as recited in claim 52 wherein the electromagnetic property of the downhole medium is selected from the group consisting of impedance, resistance, inductance and capacitance.

65. A system for determining downhole conditions comprising:

a time domain reflectometer operable to generate a transmission signal and receive a reflected signal;

a tubular operably positioned downhole in a downhole medium; and a waveguide operably contacting the downhole medium and in communication with the time domain reflectometer, the waveguide operable to propagate the transmission signal and operable to propagate the reflected signal generated responsive to an electromagnetic property of the downhole medium, wherein the time domain reflectometer provides a profile of the downhole medium by comparing the reflected signal to a control waveform.

66. The system as recited in claim 65 wherein the waveguide further comprises at least one transmission line.

67. The system as recited in claim 66 wherein the transmission line has a distal end and wherein electrical characteristics of the distal end are altered to alter characteristics of the reflected signal from the distal end.

68. The system as recited in claim 65 wherein the transmission signal further comprises a short rise time electromagnetic pulse.

69. The system as recited in claim 65 wherein the transmission signal is selected from the group consisting of electrical pulses and optic pulses.

70. The system as recited in claim 65 wherein the time domain reflectometer samples and digitizes the reflected signal.

71. The system as recited in claim 65 wherein the time domain reflectometer further comprises a step generator and an oscilloscope.

72. The system as recited in claim 65 wherein the time domain reflectometer further comprises a signal generator and sampler, a datalogger and a data interpreter.

73. The system as recited in claim 65 wherein the tubular is selected from the group consisting of sand control screens, outer shrouds, tubing, casing and pipes.

74. The system as recited in claim 65 wherein the downhole medium includes constituents selected from the group consisting of water, gas, sand, gravel, proppants and oil.

75. The system as recited in claim 65 wherein the system is operational during well completion and well production operations.

76. The system as recited in claim 65 wherein the time domain reflectometer provides a profile of the downhole medium based upon amplitude and phase of the reflected signal.

77. The system as recited in claim 65 wherein the electromagnetic property of the downhole medium is selected from the group consisting of impedance, resistance, inductance and capacitance.

78. A method for determining downhole conditions comprising the steps of:

generating a transmission signal during wellbore operation selected from the group consisting of completion operations and production operations;

propagating the transmission signal through a transmission line operably contacting a downhole medium;

reflecting the transmission signal in response to an electromagnetic property of the downhole medium;

receiving the reflected signal; and analyzing the reflected signal to determine at least one downhole condition.

79. The method as recited in claim 78 wherein the step of generating the transmission signal further comprises generating a short rise time electromagnetic pulse signal selected from the group consisting of electrical pulses and optical pulses.

80. The method as recited in claim 78 wherein the step of propagating the transmission signal through a transmission line further comprises associating the transmission line with a tubular selected from the group consisting of sand control screens, outer shrouds, tubing, casing and pipes.

81. The method as recited in claim 78 wherein the step of reflecting the transmission signal further comprises encountering a constituent selected from the group consisting of water, gas, sand, gravel, proppants and oil.

82. The method as recited in claim 78 wherein the step of receiving the reflected signal further comprises sampling and digitizing the reflected signal.

83. The method as recited in claim 78 wherein the step of analyzing the reflected signal further comprises analyzing amplitude and phase of the reflected signal.

84. The method as recited in claim 78 wherein the step of analyzing the reflected signal further comprises comparing the reflected signal to a control waveform.

85. The method as recited in claim 78 further comprising altering electrical characteristics of a distal end of the transmission line to alter characteristics of the reflected signal from the distal end.

86. The method as recited in claim 78 wherein the step of analyzing the reflected signal further comprising determining a change in an electromagnetic property of the downhole medium selected from the group consisting of impedance, resistance, inductance and capacitance.

87. An apparatus for determining downhole conditions comprising:

a tubular operably positioned in a downhole medium; and a waveguide operably contacting the downhole medium, the waveguide operable to propagate a transmission signal received from a time domain reflectometer and to propagate a reflected signal generated responsive to an electromagnetic property of the downhole medium, wherein the waveguide comprises first, second and third transmission lines such that the second transmission line is positioned substantially equidistantly between the first transmission line and the third transmission line and wherein the first, second and third transmission lines form a helical pattern about the tubular.

88. The apparatus as recited in claim 87 wherein the tubular is selected from the group consisting of sand control screens, outer shrouds, tubing, casing and pipes.

89. The apparatus as recited in claim 87 wherein the downhole medium further comprises constituents selected from the group consisting of water, gas, sand, gravel, proppants and oil.

90. The apparatus as recited in claim 87 wherein the electromagnetic property of the downhole medium is selected from the group consisting of impedance, resistance, inductance and capacitance.

91. An apparatus for determining downhole conditions comprising:

a tubular operably positioned in a downhole medium; and a waveguide operably contacting the downhole medium, the waveguide operable to propagate a transmission signal received from a time domain reflectometer and to propagate a reflected signal generated responsive to an electromagnetic property of the downhole medium, wherein the waveguide comprises first, second and third transmission lines such that the second transmission line is positioned substantially equidistantly between the first transmission line and the third transmission line and wherein the first, second and third transmission lines traverse the tubular a plurality of times.

92. The apparatus as recited in claim 91 wherein the tubular is selected from the group consisting of sand control screens, outer shrouds, tubing, casing and pipes.

93. The apparatus as recited in claim 91 wherein the downhole medium further comprises constituents selected from the group consisting of water, gas, sand, gravel, proppants and oil.

94. The apparatus as recited in claim 91 wherein the electromagnetic property of the downhole medium is selected from the group consisting of impedance, resistance, inductance and capacitance.

95. An apparatus for determining downhole conditions comprising:

a tubular operably positioned in a downhole medium; and a waveguide operably contacting the downhole medium, the waveguide operable to propagate a transmission signal received from a time domain reflectometer and to propagate a reflected signal generated responsive to an electromagnetic property of the downhole medium, wherein the waveguide comprises first and second transmission lines that form U-shaped patterns.

96. The apparatus as recited in claim 95 wherein the tubular is selected from the group consisting of sand control screens, outer shrouds, tubing, casing and pipes.

97. The apparatus as recited in claim 95 wherein the downhole medium further comprises constituents selected from the group consisting of water, gas, sand, gravel, proppants and oil.

98. The apparatus as recited in claim 95 wherein the electromagnetic property of the downhole medium is selected from the group consisting of impedance, resistance, inductance and capacitance.

99. An apparatus for determining downhole conditions comprising:

a tubular operably positioned in a downhole medium; and a waveguide operably contacting the downhole medium, the waveguide operable to propagate a transmission signal received from a time domain reflectometer and to propagate a reflected signal generated responsive to an electromagnetic property of the downhole medium, wherein the waveguide comprises first and second transmission lines that form a helical pattern about the tubular.

100. The apparatus as recited in claim 99 wherein the tubular is selected from the group consisting of sand control screens, outer shrouds, tubing, casing and pipes.

101. The apparatus as recited in claim 99 wherein the downhole medium further comprises constituents selected from the group consisting of water, gas, sand, gravel, proppants and oil.

102. The apparatus as recited in claim 99 wherein the electromagnetic property of the downhole medium is selected from the group consisting of impedance, resistance, inductance and capacitance.

103. An apparatus for determining downhole conditions comprising:

a tubular operably positioned in a downhole medium; and a waveguide operably contacting the downhole medium, the waveguide operable to propagate a transmission signal received from a time domain reflectometer and to propagate a reflected signal generated responsive to an electromagnetic property of the downhole medium, wherein the waveguide comprises first and second transmission lines that traverse the tubular a plurality of times.

104. The apparatus as recited in claim 103 wherein the tubular is selected from the group consisting of sand control screens, outer shrouds, tubing, casing and pipes.

105. The apparatus as recited in claim 103 wherein the downhole medium further comprises constituents selected from the group consisting of water, gas, sand, gravel, proppants and oil.

106. The apparatus as recited in claim 103 wherein the electromagnetic property of the downhole medium is selected from the group consisting of impedance, resistance, inductance and capacitance.

* * * * *